US005332118A

United States Patent [19]

Muckenfuhs

[11] Patent Number: 5,332,118

[45] Date of Patent: Jul. 26, 1994

[54] POP-UP TOWEL DISPENSING SYSTEM

[75] Inventor: Delmar R. Muckenfuhs, Middletown, Ohio

[73] Assignee: The Procter & Gamble Company, Cincinnati, Ohio

[21] Appl. No.: 108,206

[22] Filed: Aug. 17, 1993

[51] Int. Cl.[5] ..... A47K 10/24

[52] U.S. Cl. ..... 221/48; 221/38; 206/494

[58] Field of Search ..... 221/48, 47, 50, 55, 221/63, 51, 38; 206/494, 449

[56] References Cited

U.S. PATENT DOCUMENTS

| | | | |
|---|---|---|---|
| 1,554,178 | 9/1925 | Sickels | 206/494 |
| 1,684,878 | 9/1928 | Morris | 206/494 |
| 1,707,581 | 4/1929 | Shaffer | 221/48 |
| 2,116,792 | 5/1938 | Jacobsen | 312/58 |
| 2,125,618 | 8/1938 | Nystrand | 221/48 |
| 2,823,089 | 2/1958 | De Franco | 312/39 |
| 2,923,435 | 2/1960 | Chaplin | 221/47 |
| 3,036,729 | 5/1962 | Asman | 221/48 |
| 3,780,908 | 12/1973 | Fitzpatrick et al. | 221/48 |
| 3,836,044 | 9/1974 | Tilp et al. | 221/55 |
| 3,986,479 | 10/1976 | Bonk | 118/506 |
| 3,994,417 | 11/1976 | Boedecker | 221/48 |
| 4,138,034 | 2/1979 | McCarthy | 221/48 |
| 4,166,551 | 9/1979 | Stiros | 221/51 |
| 4,411,374 | 10/1983 | Hotchkiss | 221/63 |
| 4,775,582 | 10/1988 | Abba et al. | 428/288 |
| 4,848,575 | 7/1989 | Nakamura et al. | 206/449 |
| 4,863,064 | 9/1989 | Dailey, III | 221/48 |
| 4,865,221 | 9/1989 | Jackson et al. | 221/48 |
| 5,007,558 | 4/1991 | Allen et al. | 221/48 |
| 5,040,680 | 8/1991 | Wilson et al. | 206/459 |
| 5,050,737 | 9/1991 | Joslyn et al. | 206/494 |
| 5,201,164 | 4/1993 | Kaufman | 53/436 |

*Primary Examiner*—Kenneth W. Noland
*Attorney, Agent, or Firm*—William Scott Andes

[57] ABSTRACT

The present invention pertains to improved pop-up dispensing systems in which edge portions of adjacent towels are non-parallel when the individual towel sheets are interleaved and folded. This new configuration provides improved pop-up dispensing reliability by providing a predictable, repeatable separation process. The overlapped area formed by the overlapping end edges is tapered such that there is a point across the sheet width with the greatest overlap in the direction of the pulling force and a point across the sheet width with the least overlap in the direction of the pulling force. This configuration allows the area of maximum overlap to pull the next sheet through the dispensing aperture at the same time that the sheet separation process is starting to take place at the area of least overlap. The separation process begins at the point of least overlap and proceeds across the overlapping area along a "separation front" toward the point of greatest overlap. When the overlapping area is reduced to the extent that there is insufficient overlapping area to sustain the shear forces exerted, complete separation of the two sheets will occur. The area of overlap, length of the separation front, and amounts of overlap at the point of greatest overlap can all be tailored to provide desired separation characteristics for a particular aperture size, substrate, moistening agent, and moisture loading.

20 Claims, 5 Drawing Sheets

POP-UP TOWEL DISPENSING SYSTEM

FIELD OF THE INVENTION

The present invention pertains to pop-up dispensing systems for towel products which provide improved functional reliability in use. More particularly, the present invention pertains to improved designs for pre-moistened towel products (wet wipes) used in pop-up dispensing packages in which edge portions of adjacent towels are non-parallel when the individual towel sheets are interleaved within the package so as to form overlapping regions with a non-uniform width.

BACKGROUND OF THE INVENTION

In today's society, cleanliness is very important both from a health standpoint and an aesthetic standpoint. Whether at home or away from home, traditional cleansing tools such as soap, cloths, and running water may be unavailable, unsuitable, or inconvenient for a particular task. Cleansing of sensitive areas of the body also requires special consideration, as ordinary towel products, cleansing agents, and other associated materials such as disinfectants may cause irritation and discomfort. The use of special agents such as disinfectants and/or moisturizing agents may also be required.

At home or away from home, the cleansing of children and infants presents special considerations due to the nature and frequency of the cleansing activity, as well as the sensitivity of their skin. Of particular concern is the cleansing of sensitive body regions of infants during the changing of diapers and of adults utilizing incontinent protection articles.

To address these problems, manufacturers of consumer products have developed disposable, synthetic and/or natural fiber-based towel products which are pre-moistened with a non-irritating cleansing agent. As used herein, the terms "single-use" and "disposable" are used interchangeably to refer to towels and packages which are to be used once and then discarded, rather than retained (and perhaps cleaned) for reuse. The terms "moisture", "moistened", and "moistening agent" are intended to refer not only to water or aqueous solutions, but also any other fluid which may be useful in combination with a towel product such as disinfecting solutions (including alcohol), water-based solutions, oil-based solutions, soaps, lotions, solvents, etc. Of course, dry additives could be employed, such as powders or granules.

There are two basic types of containers for such pre-moistened towel products, namely multi-towel containers and single-towel packages.

In one typical multi-towel container, a flexible or rigid moisture-impervious container is utilized. The pre-moistened towel products are in some sort of folded, stacked arrangement of discreet towel sheets. These configurations permit one towel at a time to be exposed to the consumer and extracted from the container. These containers often have a tub-like configuration (a rigid container) or a soft, generally rectangular package configuration and are usually recloseable to protect the remaining towels.

These types of towel products and dispensing systems are not without drawbacks. Towel sheets which are merely folded and stacked one on top of the other provide no means of feeding out consecutive sheets or of facilitating the grasping of an individual towel, thus requiring the consumer to try to find a free edge of the exposed towel and peel the towel free from the remaining stack of towels. This is often a time consuming and frustrating procedure (particularly with towels having a higher moisture content) which can distract one's attention from the task at hand.

To overcome this accessibility shortcoming, multi-towel dispensers have been developed with a generally tub-like configuration and an upper panel having an opening sized and configured to hold a leading portion of a towel in an isolated orientation where it can be readily grasped by the consumer. Alternatively, such dispensers may take the form of a soft, rectangular package with a recloseable aperture on one surface. These dispensing systems are commonly known as "pop-up" dispensers, wherein the trailing edge of a towel being extracted from the package first draws the leading edge of the next towel through the opening, then typically "pops" free from the leading edge of the next towel, leaving the leading edge of the next towel held in a readily accessible position by the edges of the aperture. The towel sheets are typically either on a continuous roll, with perforations defining the ends of individual towels, or in some sort of folded and interleaved relationship. Some sort of interaction and/or connection between successive towel sheets is required in order to feed consecutive towels through the aperture.

Towel configurations of the continuous roll type with perforations typically have a comparatively higher dispensing force requirement than with discreet towels, as the perforated region must have sufficient structural integrity to prevent premature separation. Higher force requirements to complete the severing of towels at the perforations often necessitate the use of both hands, i.e., one to pull on the towel and one to restrain the package. This is particularly troublesome when one or both hands are soiled and/or one hand is otherwise occupied. Such dispensing arrangements also, due to the comparatively higher force requirements for separation, may tend to cause the leading edge of the next towel to protrude rather far beyond the opening in the package (excessive pop-up), causing difficulty in closing and resealing the package and excessive drying out of the remaining towels. Higher separation forces may also lead to the extraction of multiple towels before any separation occurs, leaving the consumer with more towel sheets than needed and a choice between wasting unused towels and trying to stuff some of them back inside the package.

One approach which attempts to address the excessive pop-up problem is the use of a two-web system (a co-facial arrangement of two superimposed webs) of perforated towels in which the perforations in one web are spaced intermediate the perforations in the other web. This double web is then accordion-folded inside a pop-up dispensing package. The theory of operation is that when separation at a line of perforation in one web occurs, the next towel presented is the next towel in the opposite web since it travels outside of the aperture along with the extracted towel and protrudes outside the aperture prior to separation of the first towel. The spacing between perforations in the two webs and the fold interval are two variables which control the amount of presentment (pop-up). While this approach attempts to address the pop-up problem, its reliance on the use of perforations still typically results in comparatively higher separation forces which often necessitates the use of both hands, and failures to separate can still result in the extraction of multiple towels.

One further approach to the pop-up/separation problem utilizes discreet, folded, and interleaved towel sheets. The towels are interfolded such that they have overlapping edge portions which are substantially parallel to one another and which adhere to one another such that successive towels are fed out through a pop-up style opening in the package. Since the towels are discreet, the difficulty with the higher separation force required in tearing along perforations is avoided.

With pop-up dispensers of this discreet, folded, interleaved variety, however, there is a narrow range of reliable pop-up action between product chaining and fallback. Chaining occurs when product separation does not occur as one sheet is removed, and thus multiple towel sheets are withdrawn in a continuous web or chain of products. Fallback occurs when the towel sheets separate prematurely before the next sheet is drawn into the dispensing orifice. The next sheet thus falls back inside the package, and the user does not have a portion of the next sheet available for grasping. The narrow operating window that occurs between these two conditions is primarily controlled by product moisture loading, dispensing orifice size and/or shape, extent of product overlap, compression during manufacture, shipping, and/or storage, and substrate properties.

Variations in the above-mentioned properties which occur in the manufacturing process, and also during shipping and/or storage of such packages, may lead to instances of product chaining or fallback. Actual usage conditions which add the additional variability of the manner in which the consumer withdraws the sheets increase the likelihood that the consumer may experience chaining (and hence product waste) or fallback (requiring reaching into the package to try to re-thread the leading edge of the next sheet through the generally narrow orifice to restart the process).

Accordingly, it would be desirable to provide an improved pop-up wet wipe dispensing system which provides increased reliability in actual consumer usage while achieving truly one-handed operation.

It would further be desirable to provide an improved pop-up wet wipe dispensing system which is more tolerant of variations in manufacturing tolerances and conditions of shipping and/or storage.

SUMMARY OF THE INVENTION

The present invention expands this operational window by utilizing discreet towel sheets in combination with a modified Z-fold stack configuration, the sheets having an overall shape such that interleaved end edges of adjacent sheets are at least partially non-parallel such that they form an overlapping region having a non-uniform width. This new configuration provides improved pop-up dispensing reliability by providing a predictable, repeatable separation process with towel sheets which are pre-moistened or otherwise have an affinity (clinging tendency) toward one another.

The key element of this concept is the overlapping relationship of the leading and trailing edges of adjacent sheets, which is dictated by the geometry of the leading and trailing edges of the sheets. The sheets are interfolded with the opposing end edges interfolded between the next adjacent sheet in the stack in an overlapping or co-extensive relationship. The overlapped area formed by the overlapping end edges is tapered such that there is at least one point across the sheet width with the greatest overlap in the direction of the pulling force and at least one point across the sheet width with the least overlap in the direction of the pulling force. This configuration allows the area of maximum overlap to pull the next sheet through the dispensing aperture at the same time that the sheet separation process is starting to take place at the area of least overlap. The separation process begins at a point of least overlap and proceeds across the overlapping area along a "separation front" toward a corresponding point of greatest overlap. When the overlapping area is reduced to the extent that there is insufficient overlapping area to sustain the shear forces exerted, complete separation of the two sheets will occur.

This configuration provides a predictable, repeatable separation process which allows the ease and timing of separation to be controlled by design. The area of overlap, length of the separation front, and amounts of overlap at the point of greatest overlap can all be tailored to provide desired separation characteristics for a particular aperture size, substrate, moistening agent, and moisture loading.

The separation is aided by the asymmetrical force application in a preferred configuration, which transforms a portion of the shear-direction pull force into a twisting, peeling motion as the sheets are withdrawn through the dispensing aperture. This asymmetrical force application increases the proportion of the shear force exerted in the vicinity of the point of least overlap in comparison with the area near the point of greatest overlap, thus increasing the force exerted at the location of the least overlap. As the overlapped area is drawn through the dispensing aperture, a separation front migrates across the sheet from the point of least overlap toward the point of greatest overlap, where it completes the separation and leaves the next sheet partially extending through the aperture for the next usage. The sheets thus dispensed are ready to use, entirely unfolded, and are dispensable with one hand, thereby greatly enhancing the convenience of such products.

The present invention therefore provides a more robust dispensing system, providing predictable performance from the first sheet in the package to the last, and throughout the range of manufacturing tolerances with respect to dimensions, amount of overlap, and moisture content. The use of these improved sheet configurations also simplifies the design of the dispensing aperture, as complex shapes and precise sizes are not required for satisfactory performance. Less restrictive apertures could also be employed, reducing the dispensing force required to extract sheets and hence also the force required to restrain the package, and in turn providing a substantial improvement in the ability to provide true one-handed operation. This dispensing system also provides reliable separation even after relatively long periods of storage which often precipitate a moisture-loading gradient as fluid migrates toward the bottom of the package, and even if relatively high compressive loading forces have been applied to the sheet stack during packaging or shipping.

BRIEF DESCRIPTION OF THE DRAWINGS

The present invention will be better understood with reference to the following Detailed Description and to the accompanying Drawing Figures, in which.

DETAILED DESCRIPTION OF THE INVENTION

Figure 1:
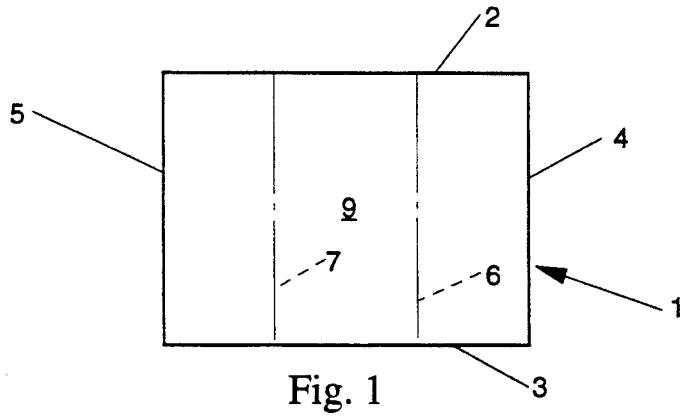
Fig. 1 (Prior Art)
FIG. 1 is a plan view of a typical individual, rectangular-cut towel sheet according to the prior art, in its unfolded state.

FIG. 1 shows a typical individual towel sheet 1, such as found in the prior art, in its flat-out, unfolded state. The sheet has two side edges, 2 and 3, two end edges, 4 and 5, and has two fold lines, represented by the dotted lines 6 and 7, for use in a Z-folded, interleaved configuration. The two side edges define the extent of the towel sheet in the transverse direction, while the two end edges define the extent of the towel sheet in the longitudinal direction. The two fold lines define a center region 9 in a Z-folded configuration. The towel sheet I has a generally rectangular overall shape with opposing edges being parallel, linear, and forming right angles with respect to one another and with the fold lines 6 and 7 being parallel to the end edges 4 and 5.

Figure 2:
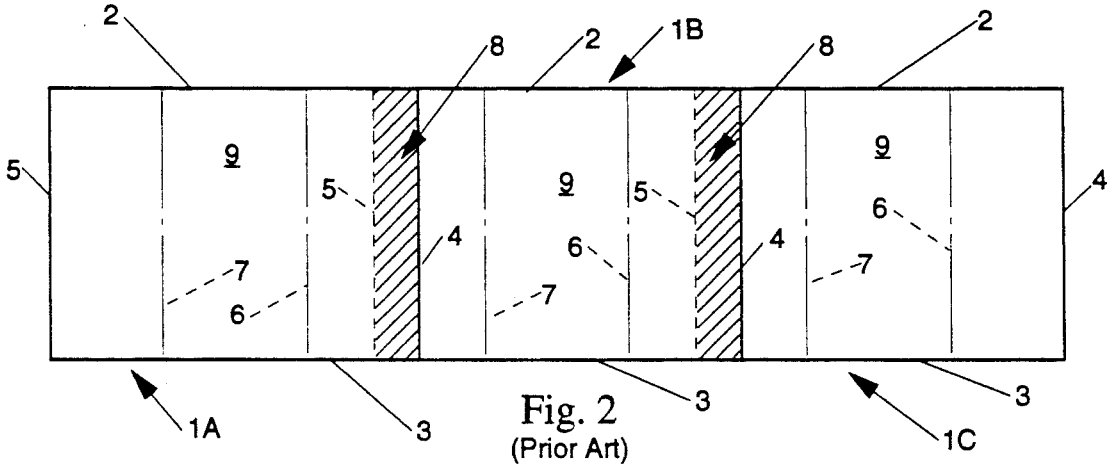
Fig. 2 (Prior Art)
FIG. 2 is a plan view of three separate, rectangular-cut towel sheets according to the prior art, depicting their overlapping relationship prior to folding.

FIG. 2 depicts three individual towel sheets 1A, 1B, and 1C (such as towel 1 depicted in FIG. 1), which have been associated with one another to form a continuous web such that they define co-extensive or overlapping regions 8 (depicted by the hatched areas) which extend from one side edge to the other side edge. The sheets have not yet been folded/interfolded and are still in their flat-out, unfolded state. Note that the overlapping end edges of adjacent sheets are substantially parallel, resulting in overlapping regions 8 having a constant width across the sheet from one side edge to the other.

Figure 3:
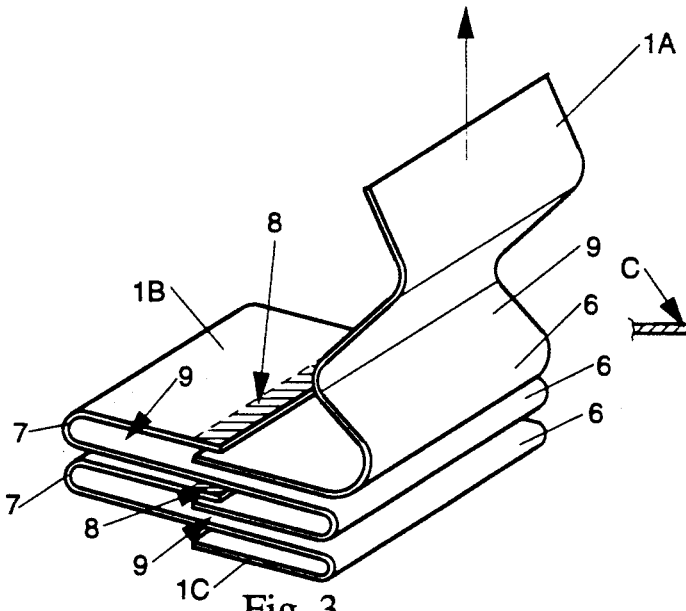
Fig. 3 (Prior Art)
FIG. 3 is a perspective view of the three separate, rectangular-cut towel sheets depicted in FIG. 2 which have been Z-folded and interleaved as in the prior art.

These individual towel sheets are interfolded along their fold lines 6 and 7 as shown in FIG. 3 so as to capture the end edge of one sheet between the end edge and center region of the adjacent sheet. Viewing the interfolded stack of sheets from the perspective of FIG. 3, the alternating sequence of overlapping regions 8 and center regions 9 is clearly visible, with the trailing edge of an upper sheet of an interleaved pair of sheets always captured beneath the leading edge of the next lower sheet. In this manner, an upward pulling force exerted on the upper sheet automatically ensures that the leading edge of the next sheet will be pulled upward from the remaining stack of sheets rather than remaining adhered to the stack.

Figure 4:
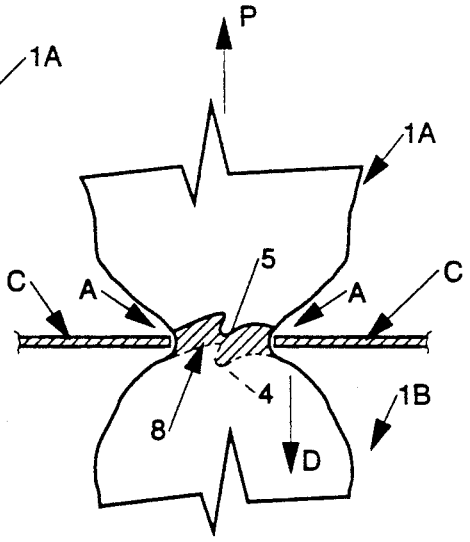
Fig. 4 (Prior Art)
FIG. 4 is a fragmentary, elevational sectional view of two separate, rectangular-cut, overlapping sheets as in FIGS. 1-3, depicting the separation process as they emerge from the aperture of a container according to the prior art.

FIG. 4 schematically illustrates the events surrounding the extraction of a towel sheet through an aperture A of a typical container C. At the instant in time depicted in FIG. 4, the overlapping region 8 happens to be located within the aperture A. The aperture A is sized sufficiently small such that it will retain the protruding portion (pop-up) of a towel sheet for ready grasping by a consumer, and tends to cause a roping effect of the towel sheets when they pass through the aperture. The term "roping effect" when used herein is simply intended to refer to the "bunching" or "buckling" of the sheets that occurs when they are drawn through a restrictive opening which causes portions of the sheets to be distorted from their initial, generally planar condition. When a sheet is extracted from the container by exerting a pulling force P (as indicated by the arrow), the trailing edge of one sheet 4 and the leading edge of the next sheet 5 pass into the area of the aperture A while still joined by the overlapping region 8. The aperture exerts a downward force D on the towel sheets to oppose the pulling force P, and these two forces exerted in opposite directions tend to pull the two sheets apart.

Separation of the two sheets tends to occur suddenly and at various random locations across the overlapping region 8, depending upon precisely how the towel sheets are constricted and roped together as they pass through the aperture. Since the overlapping region has a constant width across the sheets, there is no predictability as to where separation will begin or which direction(s) across the sheets it will propagate.

As can readily be seen in FIG. 4, if separation were to occur at or very near to the aperture A just prior to extraction of a sufficiently large portion of the lower sheet through the aperture, the lower sheet would be likely to fall back down into the container and not be retained by the aperture. On the other hand, if the separation force required is too large, separation will likely not occur until the lower sheet extends a substantial amount beyond the aperture, presenting difficulty in reclosing the container or in the worst case resulting in the extraction of a multi-towel chain of products in excess of the current requirement. The timing and location of the separation event is thus very difficult to control and predict, and is very sensitive to aperture size and shape, towel sheet properties, and the nature and quantity of the moisturizing agent utilized. Comparatively restrictive apertures are typically employed in an effort to ensure retention of the leading portion of the next towel sheet and to provide for sheet separation, which correspondingly increases the dispensing force required to extract sheets and hence also the force required to restrain the package during dispensing. This in turn limits the ability of these package configurations to provide true one-handed operation.

A preferred embodiment of a towel sheet designed according to the present invention is depicted in FIGS. 5 through 10.

Figure 5:
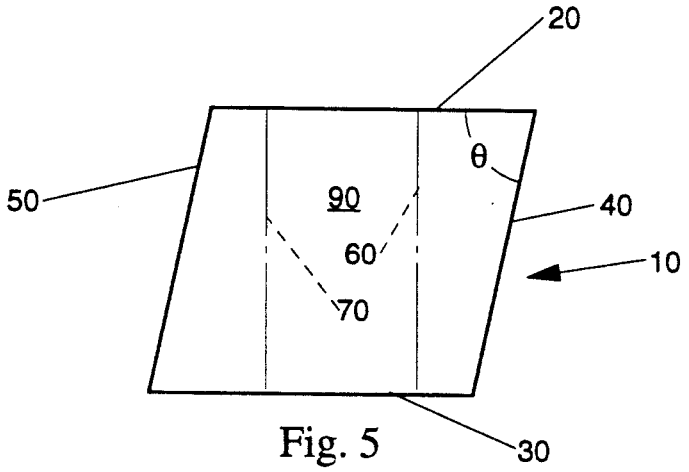
FIG. 5 is a plan view of an individual towel sheet having a generally parallelogrammatic configuration according to a preferred embodiment of the present invention.

FIG. 5 shows an individual towel sheet 10 in its flat-out, unfolded state. The sheet has two side edges, 20 and 30, two end edges, 40 and 50, and has two fold lines, represented by the dotted lines 60 and 70, for use in a Z-folded, interleaved configuration. The two side edges define the extent of the towel sheet in the transverse direction, while the two end edges define the extent of the towel sheet in the longitudinal direction. The two fold lines define a center region 90 in a Z-folded configuration. The towel sheet 10 has a generally parallelogrammatic overall shape with parallel, linear edges, and with the fold lines 60 and 70 essentially perpendicular to the side edges 20 and 30.

FIG. 5 also depicts the non-perpendicular relationship of the end edges 40 and 50 to the side edges 20 and 30. The angle $\frac{1}{4}$ (Theta) depicted in FIG. 5 represents the angle the end edge 40 makes with respect to the side edge 20, in this case some angle less than 90° (an acute angle). The angle made by the other end of end edge 40 with respect to side edge 30 would be the complementary angle of $\theta$ (180°-$\theta$).

Figure 6:
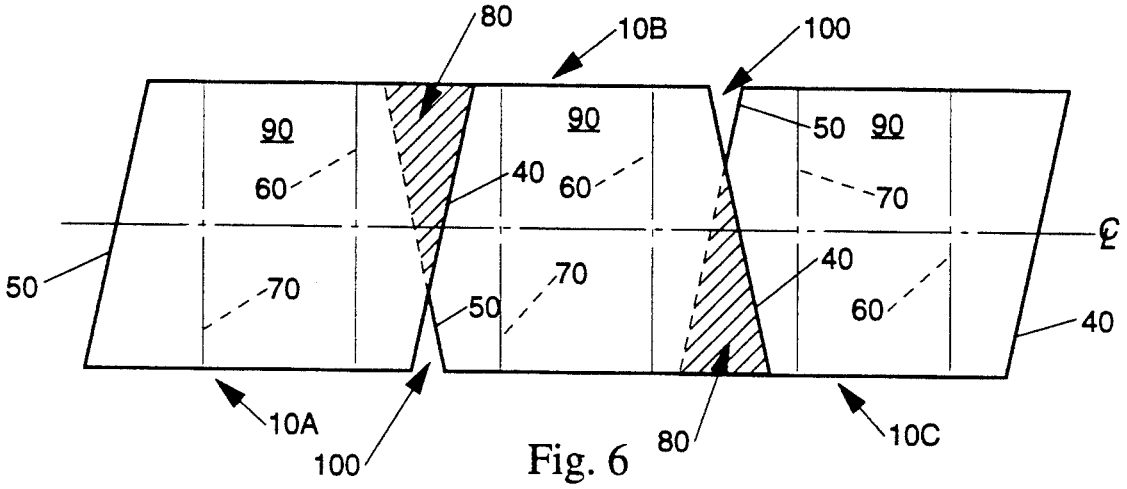
FIG. 6 is a plan view of three individual towel sheets according to the present invention, depicting their overlapping relationship prior to folding.

FIG. 6 depicts three individual towel sheets 10A, 10B, and 10C (such as towel 10 depicted in FIG. 5) which have been associated with one another to form a continuous web such that they define co-extensive or overlapping regions 80 (depicted by the hatched areas) which extend from one side edge toward the other side edge. The sheets have not yet been folded/interfolded and are still in their flat-out, unfolded state. The centerline of the associated sheets is indicated by the dashed line CL, which is generally parallel to the pull direction and the longitudinal direction.

Note that the overlapping end edges of adjacent sheets are substantially non-parallel, resulting in overlapping regions 80 having a width measured in the longitudinal direction which varies as a function of distance, in this instance linearly, across the sheet in the transverse direction from one side edge toward the other. In an instance such as depicted in FIG. 6 wherein the extent of sheet overlap and the angles of the end edges are such that the overlapping regions do not extend entirely from one side edge to the other, a region identified with the numeral 100 is formed. This region 100 corresponds to a non-overlapping area, or what may be referred to an "underlapping" area. The overlapping region 80 is essentially triangular in shape in this preferred embodiment.

Figure 7:
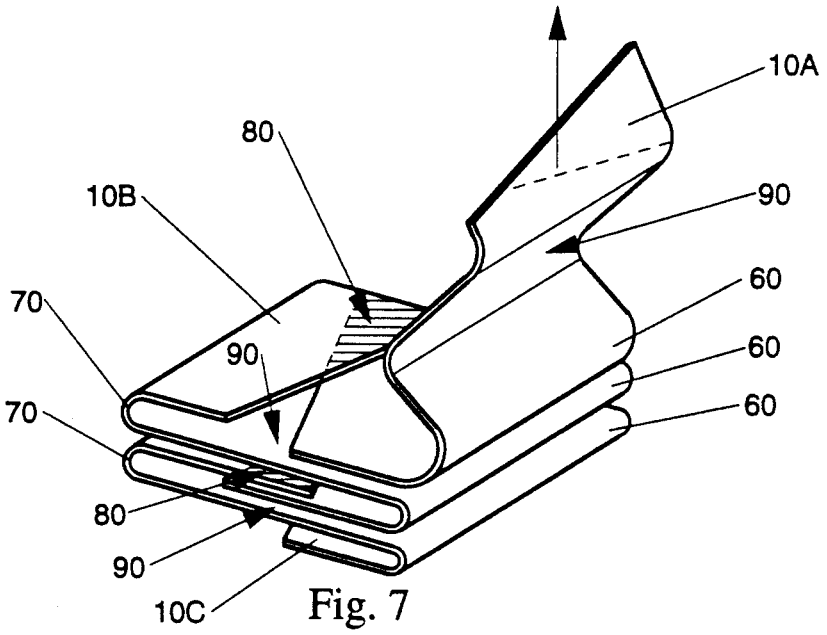
FIG. 7 is a perspective view of the three separate towel sheets depicted in FIG. 6 which have been Z-folded and interleaved according to the present invention.

These individual towel sheets are interfolded along their fold lines 60 and 70 as shown in FIG. 7 so as to capture the end edge of one sheet between the end edge and center region of the adjacent sheet. Viewing the interfolded stack of sheets from the perspective of FIG. 7, the alternating sequence of overlapping regions 80 and center regions 90 is clearly visible, with the trailing edge of an upper sheet of an interleaved pair of sheets always captured beneath the leading edge of the next lower sheet. In this manner, an upward pulling force exerted on the upper sheet automatically ensures that the leading edge of the next sheet will be pulled upward from the remaining stack of sheets rather than remaining adhered to the stack.

Figure 8:
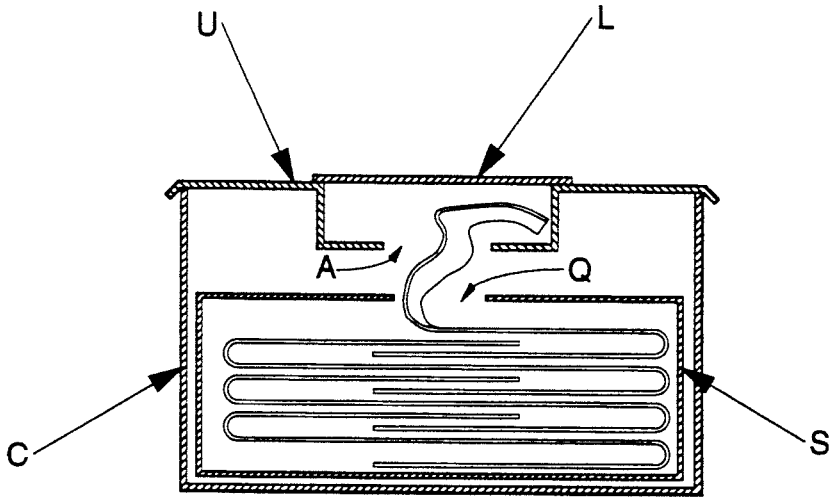
FIG. 8 is an elevational sectional view of a folded stack of separate sheets according to the present invention which has been placed in a container.

An interfolded stack of towel sheets such as depicted in FIG. 7 may be placed in a container such as container C shown in cross-section in FIG. 8. The container C depicted is intended to be merely illustrative of one possible container configuration which may be suitable for use with improved sheet configurations according to the present invention. Such a container may include a recloseable lid L incorporated into a removable upper panel U with an aperture A, and may contain the sheets within an inner soft pack S such that the supply of towel sheets within the container C may be replenished by the insertion of a new inner soft pack S. Such an inner soft pack would include an aperture Q which in registry with aperture A of the container.

Figure 9:
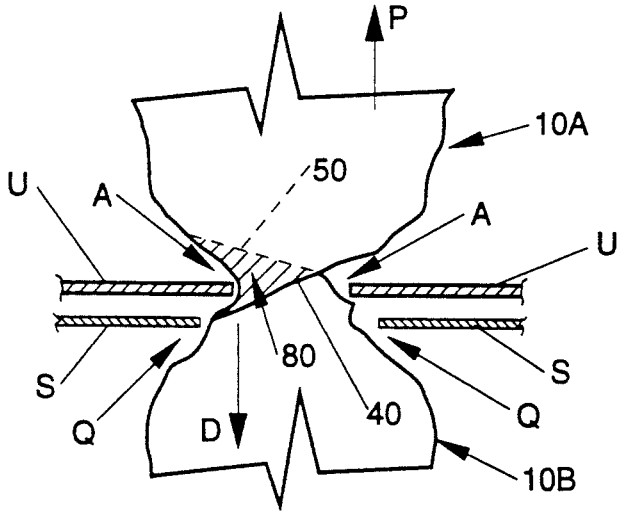
FIG. 9 is a fragmentary, elevational sectional view of two separate overlapping sheets as in FIGS. 6-8, depicting the separation process as they emerge from the aperture of a container.

FIG. 9 schematically illustrates the events surrounding the extraction of towel sheet 10A through an aperture A of a typical container C. At the instant in time depicted in FIG. 4, the overlapping region 80 happens to be located within the aperture A. The aperture A is sized sufficiently small such that it will retain the protruding portion (pop-up) of a towel sheet for ready grasping by a consumer, and tends to cause a roping effect of the towel sheets when they pass through the aperture. When a sheet is extracted from the container by exerting a pulling force P (as indicated by the arrow), the trailing edge 40 of sheet 10A and the leading edge 50 of the next sheet 10B pass into the area of the aperture while still joined by the overlapping region 80. The aperture exerts a downward force D on the towel sheets to oppose the pulling force P, and these two forces exerted in opposite directions tend to pull the two sheets apart.

The principles which are believed to be critical to the superior performance of towel sheets according to the present invention are depicted in greater detail in FIG. 10 and discussed below.

Figure 10:
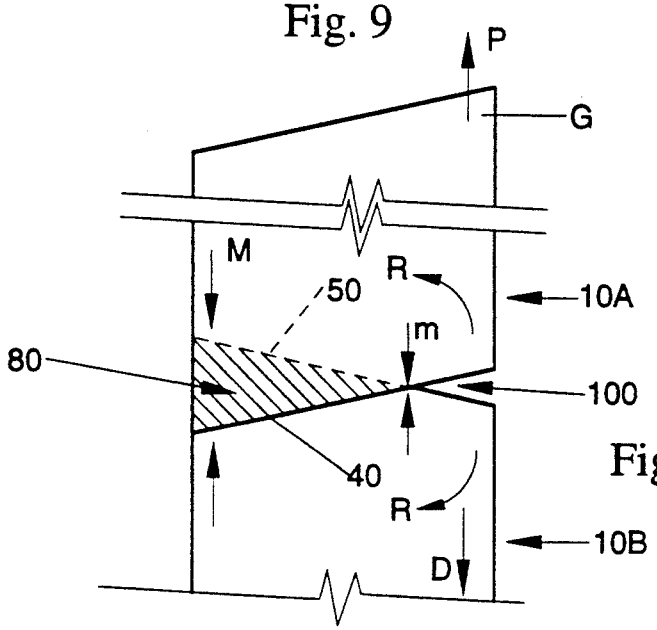
FIG. 10 is a diagrammatical elevational view of two separate overlapping sheets as in FIG. 9, schematically illustrating the separation elements according to the present invention.

For simplicity, the sheets 10A and 10B have been depicted in FIG. 10 without the roping effect which is caused by the restrictive aperture during the extraction process. Depicted in FIG. 10 are two overlapping sheets 10, the pulling force P, the trailing edge 40 of the upper sheet 10A, and the leading edge 50 of the lower sheet 10B. Also clearly depicted are the overlapping region 80 and the underlapping or notch region 100. In towel sheet configurations according to the present invention, the overlapping region 80 has at least one point of greatest or maximum overlap M and at least one point of least or minimum overlap m, both measured in the direction of the pulling force P.

The overlapping surfaces of two sheets such as 10A and 10B have an affinity for one another which is determined by a number of factors, including the surface properties of the sheet material, the amount and type of moistening or other agent (if any) utilized, static electricity, and compressive forces which may be exerted upon the stack of interfolded sheets during packaging and/or shipping. The sheets thus tend (by virtue of this "affinity") to adhere to one another by virtue of their intimate co-facial contact in the overlapping region, facilitating the tendency of the second sheet to follow the first sheet out through the aperture. When a shear force exerted in the direction of the pulling force P exceeds the shear strength of the bond in the overlapping area 80, separation of the two sheets will occur.

The overlapping area 80, however, does not have a uniform amount of overlap across the sheets, as measured in the direction of the pulling force P. Consequently, since the amount of overlap at any given point across the sheets will determine the shear force required for separation, separation will first occur where the overlap is a minimum and proceed across the overlapping region as a "separation front" moving toward the point of greatest overlap. When the overlapping area is reduced to the extent that there is insufficient overlapping area to sustain the shear forces exerted, complete separation of the two sheets will occur. The separation thus occurs in a predictable fashion, allowing the separation properties of any particular dispensing system to be designed according to a particular application.

In a preferred configuration, during the process of withdrawing a towel sheet as depicted in FIG. 10 the separation may be aided by the asymmetrical force application caused by the presence of a non-contacting, non-overlapping region 100 at one edge of the overlapped towel pair. Another contributing factor to the asymmetry of the force application is the fact that, due to the shape of the towel sheet, the farthest-extending and most likely grasped region G of the towel sheet 10A is on the same side of the overlapped towel pair as the underlapping region 100. This increases the likelihood that the consumer will in fact be exerting the pulling force on the towel sheet in an asymmetrical fashion.

The asymmetrical force application due to these and other contributing factors, such as the stretch characteristics of the substrate used, increases the proportion of the shear force exerted in the vicinity of the point of least overlap in comparison with the area near the point of greatest overlap, thus increasing the force exerted at the location of the least overlap. The overlapping region 80 is thus subjected to a rotational force component denoted by the arrows labelled R in FIG. 10, which helps ensure that the separation process begins at the point of least overlap and proceeds across the overlapping area along a "separation front" toward the point of greatest overlap. While this asymmetrical force application is helpful in achieving separation and is preferably incorporated in a preferred embodiment, it is not believed to be essential to satisfactory performance.

For towel sheets having substantially linear end edges such as depicted in FIG. 5, the angle $\theta$ (Theta) is preferably between about 0 and about 90 degrees, more preferably between about 45 and about 90 degrees, and most preferably between about 75 and about 85 degrees. In a preferred embodiment, an angle $\theta$ (Theta) of about 82 degrees has been found to perform well. This angle, in combination with the overall sheet dimensions, fold locations, and extent of interleaving, can be utilized to tailor the size and shape of the overlapping regions (including the length of the separation front) and hence the separation characteristics of the towel sheets.

The towel sheets themselves may be formed of any commonly-used tissue-type paper material, or any other similar thin and flexible sheet-like material deemed suitable for use in such a dispensing system. Such materials include, for example, woven and non-woven sheets formed of natural materials, such as cellulosic materials (cellulose, rayon/viscose, or cotton), and/or synthetic materials (polypropylene, polyethylene, or polyester), and blends thereof, with or without binders, in fibrous form or otherwise. Such materials may also be in single-ply, two-ply, or multi-ply form, so long as the resulting towel sheet has sufficient strength to avoid tearing during the dispensing operation, especially if moistened with a cleansing or other fluid additive.

The basis weight, composition, and texture (surface finish) of the towel sheets may be tailored so as to achieve the desired durability, feel, and cleansing ability. The overall dimensions of the towel sheets can be selected as appropriate to accomplish the intended tasks, with the folding and/or collating operation reducing the size of the towel sheets to fit within the desired package dimensions. Single-ply towel sheets of cellulose-based material having basis weights in the range between about 0.0043 g/cm$^2$ (0.0087 lb/ft$^2$) and about 0.0068 g/cm$^2$ (0.0138 lb/ft$^2$) have been used successfully, and overall sheet dimensions of approximately 8 inches in the longitudinal direction and approximately 7 inches in the transverse direction have performed satisfactorily.

While the advantages of the present invention may be obtained with towel sheets which are substantially moisture-free (dry), i.e., without any liquid cleansing agents or other liquids to moisten the towel sheets, the improved pop-up dispensing system herein described is particularly useful with towel sheets having a particularly high affinity for one another. Such affinity may be due to substrate properties such as surface finish or static electricity, but more commonly is caused by the addition of particular agents to the towel sheets.

Such agents in the cleansing context could contain water, mineral oil, and/or other materials that could be combined into a solution or emulsion such as: moisturizers (such as propylene glycol, glycerine, or aloe vera), emollients (such as PEG lanolin, dimethicone, vaseline, wheat germ oil, or vegetable oils), surfactants and emulsifiers (such as polysorbate 20, Pareth 23-7), preservatives and buffers (such as citric acid, benzalkonium chloride, parabens, Germal 115, Kathon, or potassium sorbate), skin caring ingredients (such as Bisabolol, Allantoin, or Camomile extract), and perhaps natural or artificial fragrances. For other uses, particularly medical uses, disinfecting solutions such as alcohol could be utilized, and such towel sheets could be adapted for use in general household cleaning situations by the addition of suitable cleaning or other agents. In some circumstances, cleansing or other agents added to the towel sheets could be in dry granular or powder form much like talcum powder, and still serve to increase the affinity of the towel sheets for one another.

With respect to the quantity of moisturizing or other agent employed with the towel sheets, such quantity may be tailored to serve the particular needs of the application. A general trend observed with many common additives seems to be that the greater the quantity of additive agent employed, the greater the "stickiness" or "clinginess" of the towel surfaces tends to be, and hence the greater the affinity of the towel sheets for one another in the overlapping region. In terms of fluid loading of the towel sheets, the quantity employed is often described in terms of a multiple of the dry basis weight of the towel substrate (denoted as "X"). One representative fluid loading which has performed well with towel sheets according to the present invention is 3X, which means that with this loading a quantity of fluid having a weight of three times the dry basis weight of the towel sheets is absorbed into and contained within the towel sheets. The size and shape of the overlapping region may be varied to account for the variation in affinity between towel sheets which is due at least in part to the variations in fluid loading.

The present invention permits less restrictive apertures to be employed, reducing the dispensing force required to extract sheets and hence also the force required to anchor the package, and in turn providing a substantial improvement in the ability to provide true one-handed operation. This dispensing system also provides reliable separation even after relatively long periods of storage which often precipitate a moisture-loading gradient as fluid migrates toward the bottom of the package, and even if relatively high compressive loading forces have been applied to the sheet stack during packaging or shipping.

The side edges of the towel sheets are not believed to play a significant role in the separation process, although they may in part contribute to the performance characteristics of the overall package by influencing the degree of holding forces which the aperture exerts to hold the pop-up portion of the towel sheet. Consequently, while the Drawing Figures have illustrated the use of parallel side edges which in general are parallel to the direction of withdrawal of the towel sheets, it is within the scope of the present invention that side edges may be non-parallel and/or non-linear as well.

While the representative container depicted in FIG. 8 illustrates the use of a rigid outer container and a flexible inner container (to promote refillability of the rigid container), the principles of the present invention will be equally applicable to any suitable storage container such as one in which the only container is a rigid container which directly contains the sheets or in which the only container is a flexible container, such as a travel-type convenience package.

Improved pop-up towel dispensing systems according to the present invention may be tailored to accomodate virtually any number of individual towel sheets per package. For example, smaller easily transportable packages may be designed to contain a comparatively small number of sheets (such as about 2 to about 20 per package), while larger packages suitable for use in one particular location may contain large numbers of sheets (such as about 20 to about 200 per package).

Other suitable towel sheet designs according to the present invention are depicted in FIGS. 11 through 16. In each of these Figures, the centerline of the associated towel sheets is indicated by the dashed line CL which is generally parallel to the pull direction and the longitudinal direction.

Figure 11:
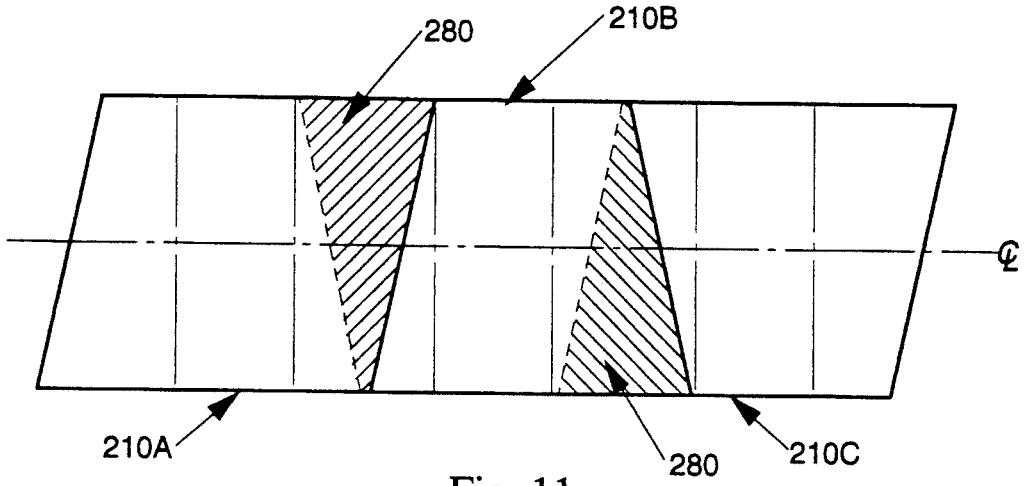
FIG. 11 is a plan view similar to FIG. 6 of three separate towel sheets which illustrates another embodiment of the present invention, depicting the r overlapping relationship prior to folding.

FIG. 11 depicts a series of parallelogram-shaped towel sheets 210A, 210B, and 210C in a view similar to that shown in FIG. 6, but with the overlapping regions 280 extending entirely across the sheets from one side edge to the other. Although there is no underlapping or notch region in this configuration, there are still the requisite points of maximum and minimum overlap in the overlapping region, and hence the advantages of the present invention are retained.

Figure 12:
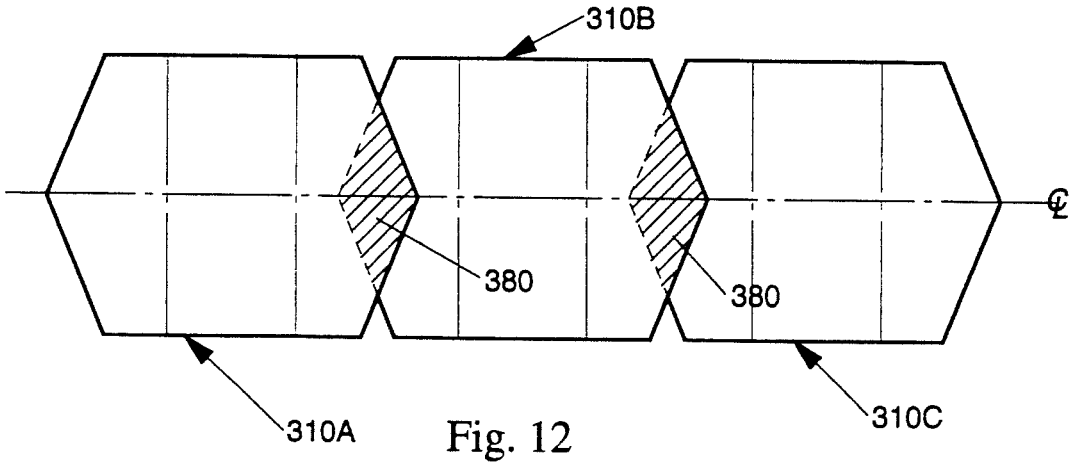
FIG. 12 is a plan view similar to FIG. 6 of three separate towel sheets illustrating still another embodiment of the present invention, depicting their overlapping relationship prior to folding.

A symmetrical towel sheet configuration is depicted in FIG. 12, wherein a series of three towel sheets 310A, 310B, and 310C have a symmetrical shape with respect to the centerline CL of the sheets. The overlapping end edges of adjacent sheets are still non-parallel, and in this configuration the overlapping regions 380 have two points of minimum overlap and one point of maximum overlap. As such, separation would begin at one or both points of minimum overlap and proceed toward the point of maximum overlap.

Figure 13:
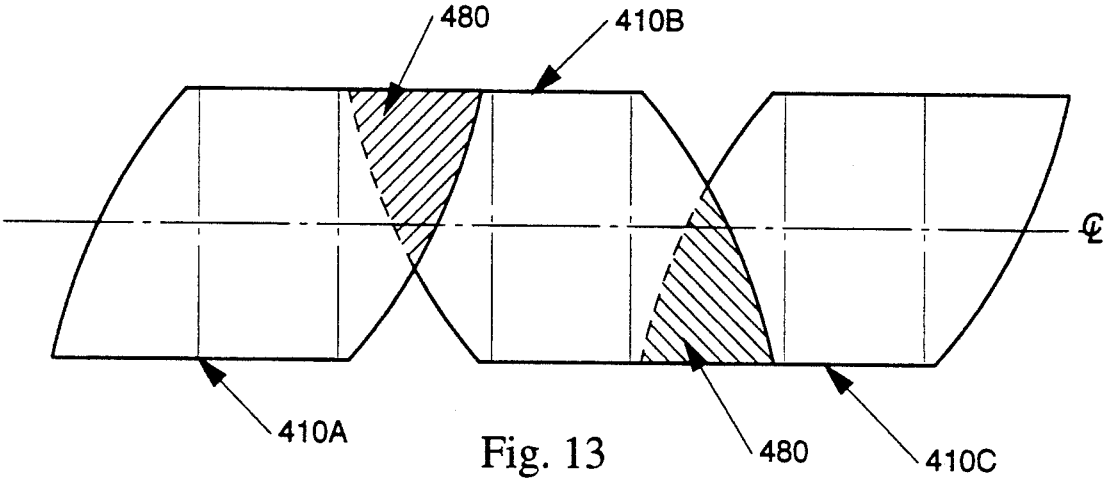
FIG. 13 is a plan view similar to FIG. 6 of three separate towel sheets according to still another embodiment of the present invention, depicting their overlapping relationship prior to folding.
Figure 14:
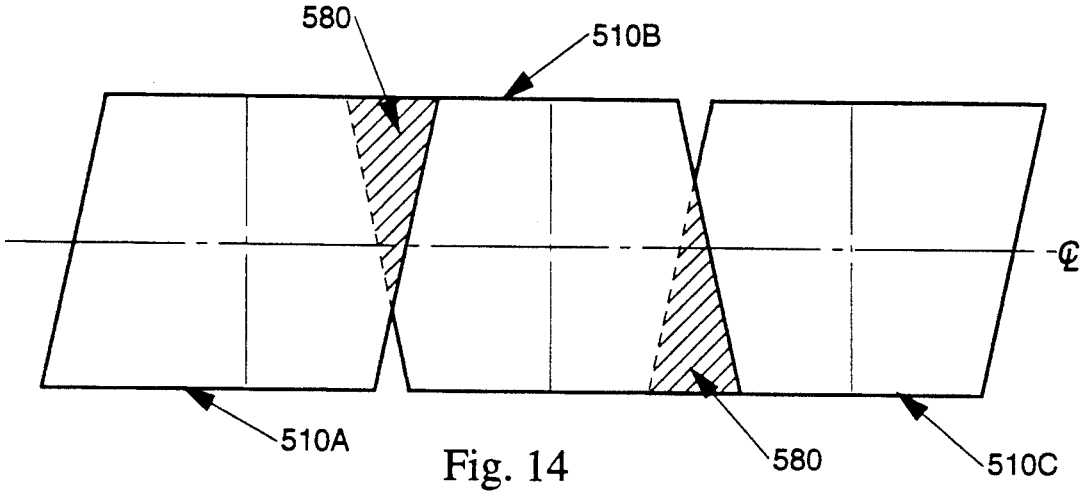
FIG. 14 is a plan view similar to FIG. 6 of three separate towel sheets showing a further embodiment of the present invention, depicting their overlapping relationship prior to folding.

The overlapping end edges of adjacent sheets need not be linear in nature, as in the case of the series of three towel sheets 410A, 410B, and 410C depicted in FIG. 13. The end edges may be arcuate or curvilinear, or part linear and part non-linear. Note that the overlapping areas 480 still include the points of maximum and minimum overlap, and hence the separation process would proceed as described previously.

While a Z-folded configuration is presently preferred, the number of folds in each particular sheet is not critical to the present invention. As in the series of towel sheets 510A, 510B, and 510C depicted in FIG. 14, a C-folded configuration wherein each individual sheet includes only one fold line may also be utilized. In this instance, in forming the sheet stack as depicted in FIG. 7 each sheet would be folded into a C shape, and each layer of material proceeding downward through the stack would include an overlapping region 580 of two adjacent towel sheets, wherein the trailing end of one towel is captured between the two halves of the following towel. Other configurations incorporating greater numbers of folds may also prove suitable for use with towel sheets according to the present invention.

On the other hand, as the number of folds is not critical to the present invention, in some circumstances it may be desirable to roll the associated towel sheets onto a spindle or core to form a roll-type dispensing system in which the sheets have no folds whatsoever. In sum, the approaches utilized to arrange the sheets within the dispensing package of the present invention may include various numbers of folds with interfolding of the sheets, rolling the sheets, maintaining the sheets in a straight linear web, or any other approach consistent with the design of the overall package.

Figure 15:
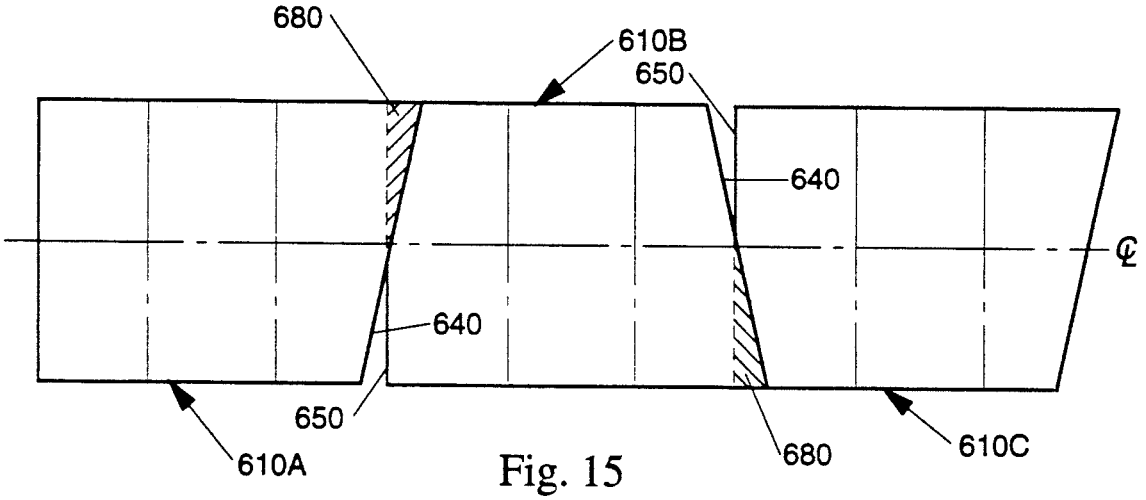
FIG. 15 is a plan view similar to FIG. 6 of three separate towel sheets showing still a further embodiment of the present invention, depicting their overlapping relationship prior to folding.

As shown in FIG. 15, which is a plan view similar to FIG. 6 of three separate towel sheets 610A, 610B, and 610C prior to folding, it may also be desirable to modify only one end edge of a series of towel sheets (in this instance edge 640) and leave one end edge (in this instance edge 650) in a conventional, rectangular configuration. As can readily be seen in FIG. 15, the overlapping relationship of adjacent towel sheets is still such that the overlapping regions 680 have a point of greatest overlap and a point of least overlap, and hence the advantages of the present invention are retained.

Figure 16:
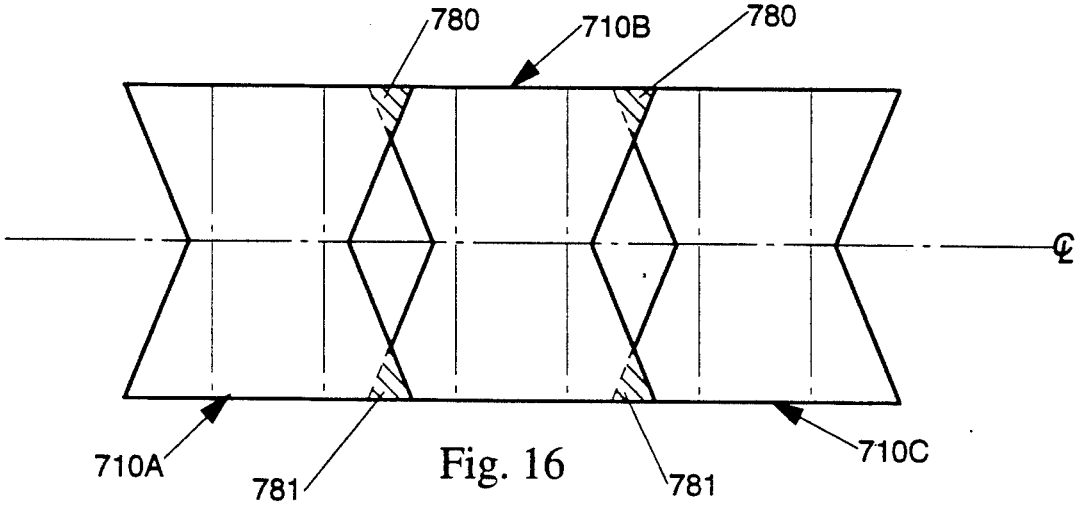
FIG. 16 is a plan view similar to FIG. 6 of three separate towel sheets showing still a further embodiment of the present invention, depicting their overlapping relationship prior to folding.

FIG. 16 is a plan view similar to FIG. 6 of three separate towel sheets 710A, 710B, and 710C showing still a further embodiment of the present invention, in which the end edges are notched to form what may be termed a "forked" or "banner" end. When such towel sheets are then associated as depicted in FIG. 16, each pair of adjacent sheets forms two distinct overlapping regions 780 and 781, each having a point of greatest overlap and a point of least overlap. In like manner, the end edges of adjacent towels may be configured so as to produce virtually any number of overlapping regions, and so long as any particular overlapping region has at least one point of greatest overlap and at least one point of least overlap, the advantages of the present invention would be retained with respect to separation of that overlapping region.

While particular embodiments of the present invention have been illustrated and described, it would be obvious to those skilled in the art that various changes and modifications can be made without departing from the spirit and scope of the present invention. For example, the overall size and shape of the individual towel sheets, the number and orientation of the folds, the number and shape of the overlapping regions, the towel materials, moistening agents, and the overall package design could be adapted to suit a particular application. The shape or size of each sequential towel sheet could be varied such that the web consists of a non-uniform series of towel sheets. It is intended to cover in the appended claims, all such modifications that are within the scope of this invention.

What is claimed is:

1. In a web comprising a plurality of separate sheets suitable for use in a pop-up dispensing system, each of said sheets having two opposing side regions and two opposing end regions joining said opposing side regions, said sheets having a longitudinal direction which extends between said side regions and a transverse direction which is perpendicular to said longitudinal direction, and said end regions each including an end edge which extends across said sheets between said opposing side regions and defines a maximum longitudinal length of said sheets, the improvement comprising:

(a) said sheets being associated with one another to form said web such that the end regions of each sheet overlie end regions of adjoining sheets in a co-extensive relationship so as to form at least one pair of adjacent sheets having at least one overlapping region bounded at least partially by an opposing end edge of each sheet of said at least one pair of adjacent sheets; and (b) said opposing end edges being at least partially non-parallel with one another, and said at least one overlapping region having at least one point of greatest overlap and at least one point of least overlap measured in said longitudinal direction, said at least one point of greatest overlap being greater than said at least one point of least overlap.

2. The web of claim 1, wherein said end edges are substantially linear in shape.

3. The web of claim 2, wherein at least one edge forms an acute angle with respect to at least one side edge.

4. The web of claim 3, wherein said acute angle is between about 75 degrees and about 85 degrees.

5. The web of claim 4, wherein said sheets comprise a cellulosic material.

6. The web of claim 1, wherein said end edges are substantially non-linear in shape.

7. The web of claim 1, wherein said end edges of an individual sheet are substantially parallel to one another.

8. The web of claim 1, wherein said end edges of an individual sheet are substantially non-parallel to one another.

9. The web of claim 1, wherein said sheets are premoistened with a moistening agent.

10. The web of claim 9, wherein said moistening agent comprises a cleansing agent.

11. The web of claim 1, wherein said sheets have an overall shape which is substantially symmetrical with respect to a longitudinal centerline.

12. The web of claim 1, wherein said sheets have an overall shape which is substantially asymmetrical with respect to a longitudinal centerline.

13. The web of claim 1, wherein said at least one overlapping region includes at least two points of least overlap measured in said longitudinal direction.

14. The web of claim 1, wherein said at least one overlapping region includes at least two points of greatest overlap measured in said longitudinal direction.

15. The web of claim 1, wherein a longitudinal extent of said at least one overlapping region increases substantially linearly from said at least one point of least overlap toward said at least one point of greatest overlap.

16. In a pop-up dispensing system for dispensing folded sheets, said dispensing system including a plurality of separate sheets and a dispensing aperture, each of said sheets having two opposing side regions and two opposing end regions joining said opposing side regions, said sheets having a longitudinal direction which extends between said opposing side regions and a transverse direction which is perpendicular to said longitudinal direction, and said opposing end regions each including an end edge which extends across said sheets between said opposing side regions and defines a maximum longitudinal length of said sheets, the improvement comprising:

(a) said sheets being associated with one another to form a continuous web such that the end regions of each sheet overlie end regions of adjoining sheets in a co-extensive relationship so as to form at least one pair of adjacent sheets having at least one overlapping region bounded at least partially by an opposing end edge of each sheet of said at least one pair of adjacent sheets; and (b) said opposing end edges being at least partially non-parallel with one another, and said at least one overlapping region having at least one point of greatest overlap and at least one point of least overlap measured in said longitudinal direction, said at least one point of greatest overlap being greater than said at least one point of least overlap;

whereby when a sheet adjacent to said dispensing aperture is withdrawn through said dispensing aperture, the end portion of said sheet exerts a pulling force on the end portion of a subsequent adjacent sheet via said overlapping region to partially withdraw said interleaved end portion of said subsequent adjacent sheet through said dispensing aperture, and whereby complete separation of said overlapping region occurs generally outside of said dispensing aperture to free said sheet for use and form a free end portion of said subsequent sheet, and whereby said free end portion of said subsequent adjacent sheet is retained outside said dispensing aperture for grasping.

17. In a pop-up dispensing system for dispensing folded sheets, said dispensing system including a plurality of separate sheets and a dispensing aperture, each of said sheets having two opposing side regions and two opposing end regions joining said opposing side regions, said sheets having a longitudinal direction which extends between said opposing, side regions and a transverse direction which is perpendicular to said longitudinal direction, and said opposing end regions each including an end edge which extends across said sheets between said opposing side regions and defines a maximum longitudinal length of said sheets, each of said sheets further having at least one fold line extending generally transversely across said sheets from one side region to the other side region, said at least one fold line being disposed intermediate said opposing end regions, the improvement comprising:

(a) each of said sheets being folded along said at least one fold line and said sheets being superposed on one another with end portions of adjacent sheets being interleaved with one another such that an end portion of one sheet separates end portions of an adjacent sheet from one another;

(b) said sheets being associated with one another to form a continuous web such that the end regions of each sheet overlie end regions of adjoining sheets in a co-extensive relationship so as to form at least one pair of adjacent sheets having at least one overlapping region bounded at least partially by an opposing end edge of each sheet of said at least one pair of adjacent sheets; and (c) said opposing end edges being at least partially non-parallel with one another, and said at least one overlapping region having at least one point of greatest overlap and at least one point of least overlap measured in said longitudinal direction, said at least one point of greatest overlap being greater than said at least one point of least overlap;

whereby when a sheet adjacent to said dispensing aperture is withdrawn through said dispensing aperture, the end portion of said sheet exerts a pulling force on the end portion of a subsequent adjacent sheet via said overlapping region to partially withdraw said interleaved end portion of said subsequent adjacent sheet through said dispensing aperture, and whereby complete separation of said overlapping region occurs generally outside of said dispensing aperture to free said sheet for use and form a free end portion of said subsequent sheet, and whereby said free end portion of said subsequent adjacent sheet is retained outside said dispensing aperture for grasping.

18. The dispensing system of claim 17, wherein said dispensing aperture forms an opening in a container, said container surrounding and containing said sheets.

19. The dispensing system of claim 18, wherein said sheets have an overall shape which is substantially symmetrical with respect to a longitudinal centerline.

20. The dispensing system of claim 18, wherein said sheets have an overall shape which is substantially asymmetrical with respect to a longitudinal centerline.

* * * * *